United States Patent [19]

Titchener et al.

[11] Patent Number: 4,848,480

[45] Date of Patent: Jul. 18, 1989

[54] METHOD AND APPARATUS FOR WIRE LINE PROTECTION IN A WELL

[75] Inventors: Paul F. Titchener, Menlo Park; Michael J. M. Walsh, Kentwood; Merle E. Hanson, Livermore, all of Calif.

[73] Assignee: Comdisco Resources, Inc., San Francisco, Calif.

[21] Appl. No.: 291,383

[22] Filed: Dec. 23, 1988

Related U.S. Application Data

[63] Continuation of Ser. No. 919,073, Oct. 15, 1986, abandoned.

[51] Int. Cl.[4] ..... E21B 33/072

[52] U.S. Cl. ..... 166/385; 166/70; 166/75.1; 166/308; 166/252

[58] Field of Search ..... 166/67, 70, 75.1, 77, 166/80, 378, 379, 380, 385, 387, 84, 308, 250, 252

[56] References Cited

U.S. PATENT DOCUMENTS

| | | | |
|---|---|---|---|
| 2,684,118 | 7/1954 | Osmun | 166/70 |
| 2,700,734 | 1/1955 | Egan et al. | 166/252 |
| 2,869,642 | 1/1959 | McKay et al. | 166/250 |
| 3,496,998 | 2/1970 | Weaver | 166/385 |
| 4,076,079 | 2/1978 | Herricks et al. | 166/308 |
| 4,633,951 | 1/1987 | Hill et al. | 166/385 |

*Primary Examiner*—Bruce M. Kisliuk

*Attorney, Agent, or Firm*—Christie, Parker & Hale

[57] ABSTRACT

An apparatus for protecting a wireline at a top of a well from wear due to flow of fluid about the wireline includes a valve assembly coupled to a wellhead for introducing fluid into a well. A wireline adaptor section passes the wireline from outside the well and adaptor section into the well through the wellhead. The wireline adaptor section includes a hollow rigid tube passing from the wireline adaptor section into a flow passage for the fluid and has an end extending away from the adaptor section. A flexible bushing is coupled to an extends beyond the end of the tube in a direction toward the wellhead. A wireline is slidable from the outside of the adaptor section the tube and bushing and out the end of the tube.

20 Claims, 7 Drawing Sheets

Fig. 2,
58
56
44
46
48
54
52
50
28
24
64
62
42
34
38
68
60
78
12
66
76
72
74
18
80
40
26
70
36
32
30
82
12

METHOD AND APPARATUS FOR WIRE LINE PROTECTION IN A WELL

CROSS-REFERENCE TO RELATED APPLICATIONS

This is a continuation of application Ser. No. 06/919,073, filed Oct. 15, 1986 now abandoned.

BACKGROUND OF THE INVENTION

1. Field of the Invention

This invention relates to methods and apparatus for protecting a wire line and more specifically to a tube and bushing arrangement for protecting a wire line near the top of a well while fluid is being pumped into the well about the wire line.

2. Related Art

In situations such as fracturing in oil wells for secondary production of oil, fluid is pumped into a well at high pressure and flow rate. Flow is indicated by the arrows 10 in FIG. 1. A wire line 12 having a tool 14 attached to the end may be passed into the well at a point near the wellhead 16 for performing operations in the well. The wire line may pass into the well from outside through a rigid pipe 18. The pipe protects the wire line at the point where the wire line enters the flow passage 20.

The rigid pipe may typically be several feet long over that portion of the pipe which is inside the flow passage. Though the rigid pipe protects that portion of the wire line interior to the pipe, there is still a substantial amount of turbulence in the fluid flowing past the pipe and wire line. Since the pipe is rigid and the wire line is relatively flexible compared to the pipe, it is believed that the fluid flow past the pipe and wire line causes that portion of the wire line external to the pipe to whip back and forth with respect to the pipe. This causes wear on the wire line and ultimately severance of the wire line at the point 22 where the wire line exits the pipe.

BRIEF SUMMARY OF THE INVENTION

Briefly, an apparatus and method are disclosed for protecting a wire line at a top of a well from wear due to flow of fluid about the wire line includes means coupled to a well head for introducing fluid into the well. A wire line adaptor section for the wellhead is coupled between the fluid introducing means and the wellhead for passing the wire line from outside the well into the well. The adaptor section includes a wall having an aperture formed therein, the wall defining a flow passage having an axis for passing the fluid from the fluid introducing means to the well. A hollow rigid tube passes from the outside of the flow passage to the flow passage through the aperture and includes an end extending substantially parallel to the flow axis. A flexible bushing is coupled to and extends below the end of the tube. A wire line is slidable from the outside of the flow passage through the tube and bushing into the flow passage. In the preferred embodiment, the bushing comprises a helical coil and may include a flexible tube covering the coil. In an alternative embodiment, the bushing may be a flexible tube attached to the end of the rigid tube.

DETAILED DESCRIPTION OF THE PREFERRED EMBODIMENTS

Figure 1:
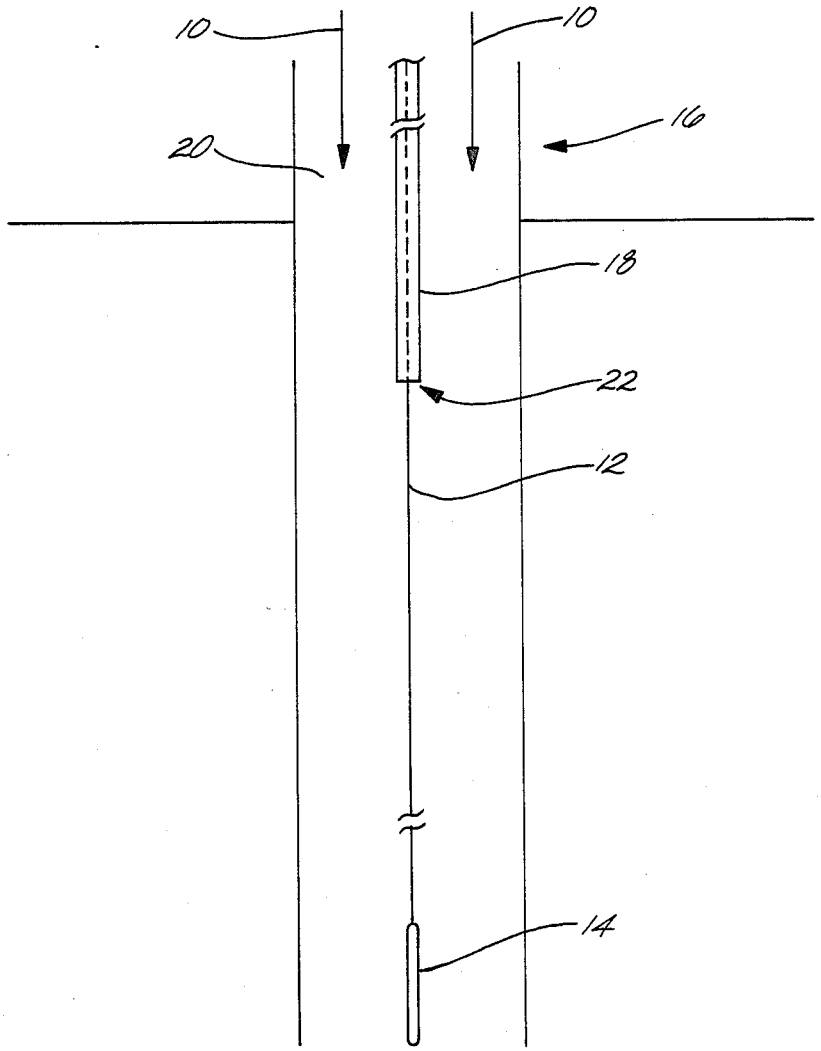
Fig. 1. PRIOR ART
FIG. 1 is a schematic and cross sectional view of an oil well showing a prior embodiment of a wire line protector placed near a wellhead for protecting a wire line passing therethrough into the well.
Figure 2:
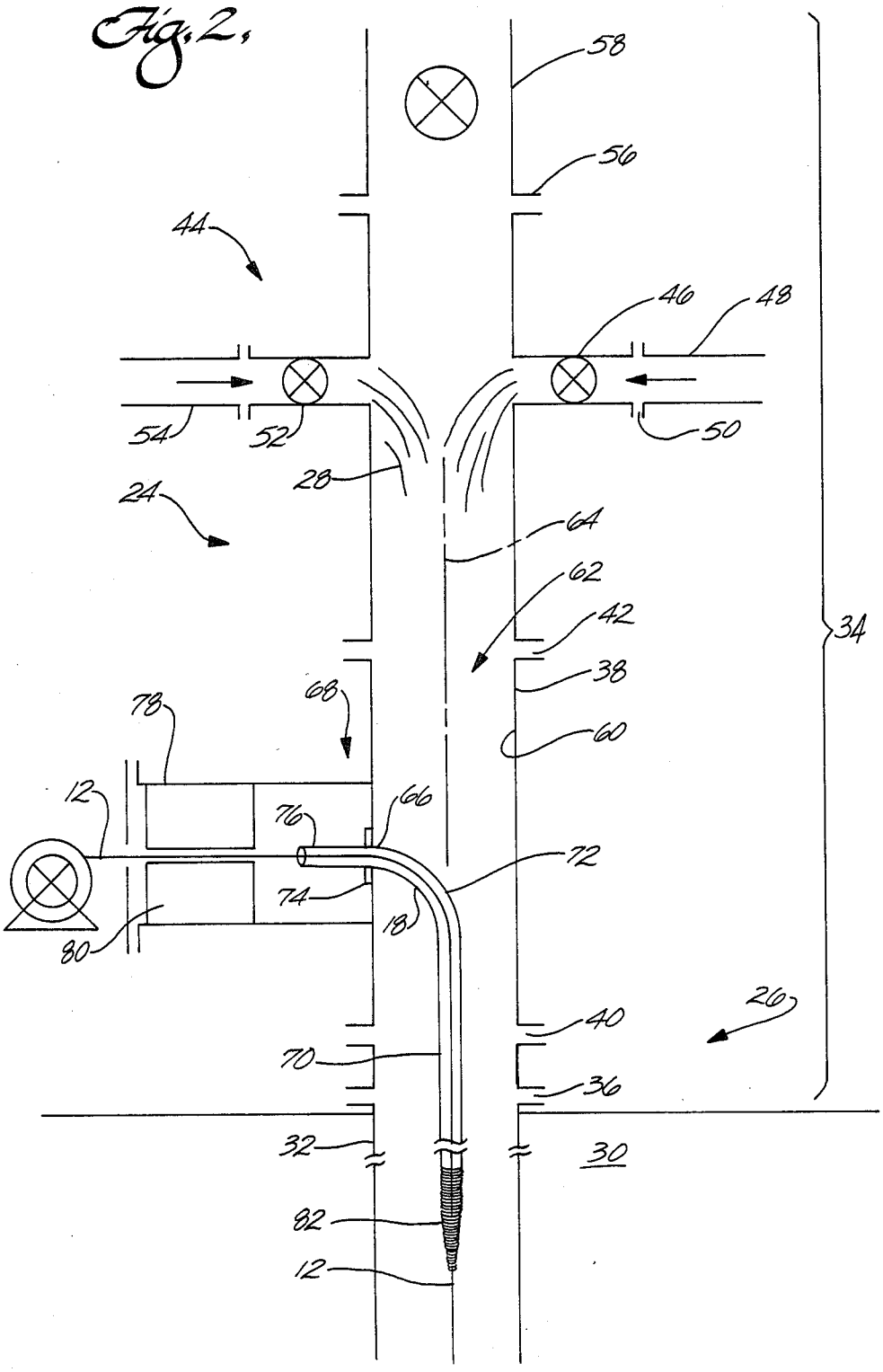
FIG. 2 is a schematic and cross sectional view of a wellhead and wellhead equipment including a rigid pipe and a bushing for protecting a wire line from wear resulting from the flow of the fluid and embodying the present invention.

FIG. 2 shows an apparatus for introducing fluid 28 and a wire line into a top of a well 26 and for protecting the wire line 12 from wear due to flow of fluid 28 about the wire line. The well extends into the earth 30 and includes a casing 32 extending into the well. The wellhead 34 is attached to the surface casing and serves to mount the remaining equipment on the well. The wellhead is mounted to the surface or casing top of 32 through a flange 36.

A wire line adaptor section 38 is mounted to the wellhead through a flange 40. The wire line adapting section would be similar to other wellhead equipment used to make up a Christmas tree. The section preferably includes an additional flange 42 for mounting other sections of a conventional Christmas tree to the wire line adapting section.

One piece of equipment to be mounted to the adapting section is a section 44 for introducing fluid into the well. The section 44 is in the form of a valve assembly including at least one valve 46 to which a flow pipe 48 may be attached through a flange 50 for introducing fluid to the valve assembly. The flow pipe leads to a pumper (not shown) for pumping fluid into the well. For example, during a fracturing operation, fracturing fluid including a gel and propant will be pumped into the well for forming a fracture. Additional valves 52 may be used to provide additional input of fluid from respective flow pipes 54, one of each of which is shown in FIG. 2. In some operations, a fracturing gel is introduced from one pumper while a propant is introduced from another pumper.

A flange 56 is used to attach additional surface plumbing 58 to the wellhead equipment.

Considering the wire line adaptor section 38 in more detail, the section is formed from pipe or other material suitable for withstanding the pressure and other forces developed during fracturing. The section in the embodiment shown in FIG. 2 is preferably mounted between the valve assembly and the wellhead. The section includes a wall 60 defining a flow passage 62 and, having a longitudinal axis 64, for passing the fluid from the valve assembly into the well. The wall includes an aperture 66 for introducing the rigid pipe from the outside 68 of the section to the flow passage 62. The aperture is formed to accept the pipe or rigid tube 18 and its shape will depend upon the particular shape of the pipe or tube. In the embodiment shown in FIG. 2, the rigid tube is a steel pipe having a substantial section 70 extending into the well substantially parallel to the axis 64. The length of the substantial section 70 is preferably on the order of ten feet.

The rigid tube includes a curved section 72 for passing through the aperture 66 and for maintaining the coaxial section of the pipe aligned with the flow of the fluid. The curved section extends through the aperture in the wall and is fixed at the wall through a reinforced weld 74 or other suitable means for mounting the rigid tube to the section. The pipe terminates in an external tube section 76 beyond the wall. The external section extends into a tube housing 78 for protecting the external tube section 76. The tube housing is mounted or formed on the wire line adaptor section and is preferably orthogonal thereto. The housing includes packing 80 for sealing the wire line 12 in the housing. The sealing means may be in the form of a packing gland or other seal for preventing expulsion of the wire line or fracturing fluid from the rigid tube and the well.

Attached to that end of the rigid tube which is in the flow channel is a flexible bushing 82 for damping the vibration or oscillation movement of the wire line 12 with respect to the rigid tube. The bushing is coupled to and extends below the end of the tube. In the preferred embodiment, the bushing is made from a relatively hard steel spring and is welded to the end of the tube to extend between two and three feet below the end of the tube.

Figure 4:
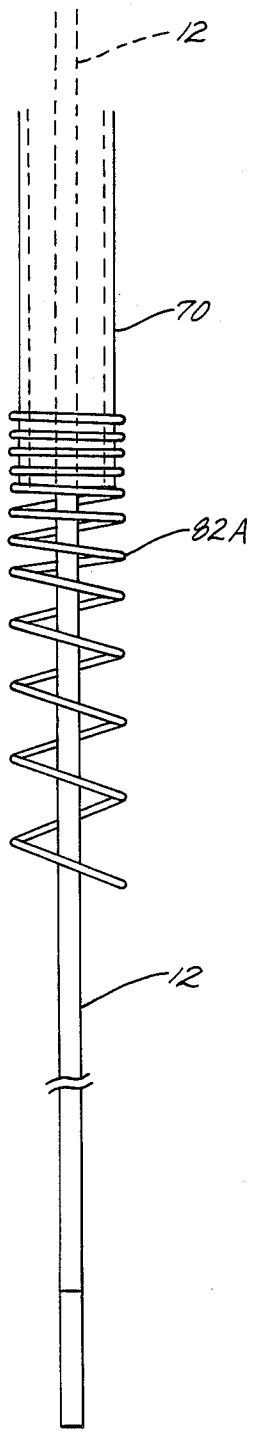
FIG. 4 shows a schematic and side elevational view of a pipe and bushing with a wire line passing therethrough according to the present invention.

As can be seen more clearly in FIG. 4, a preferred embodiment of the bushing 82A is a helical coil spring having an increasing pitch as the coil spring extends away from the rigid tube. Regardless of the shape of the bushing, it is preferred that the bushing be more flexible at its free end and less flexible at the point where the bushing is fixed to the end of the tube. This minimizes the frictional forces between the end of the bushing and the wire line at the point where the wire line exists the bushing. As shown in FIG. 2, the bushing may have a converging inside and outside diameter, for example so that the inside diameter of the bushing at the end of the rigid tube is equal to that of the rigid tube. Alternatively, the inside diameter of the bushing may be maintained constant, as shown in FIG. 4. The end of the rigid tube may have a reduced outside diameter to accept the upper end of the bushing to minimize the obstruction to flow of fluid along the outside of the tube and bushing.

Figure 5:
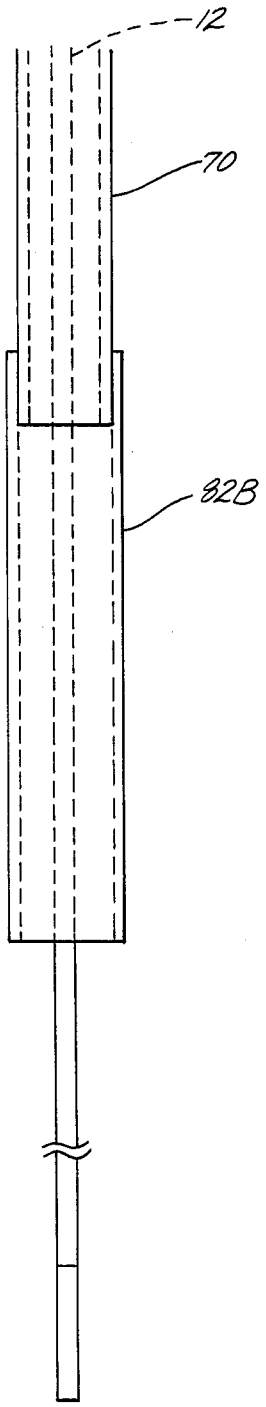
FIG. 5 is a schematic and side elevational view of a pipe and a further embodiment of a bushing, with a wire line passing therethrough according to the present invention.
Figure 7:
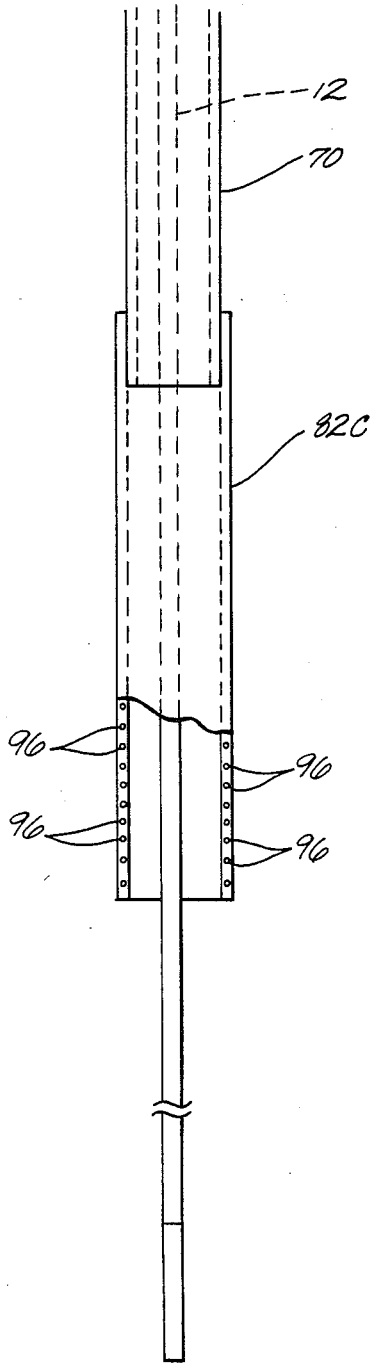
FIG. 7 is a schematic showing a further embodiment of the present invention.

FIG. 5 shows an alternative embodiment of the bushing mounted to the end of the rigid tube. The bushing 82B is in the form of a rubber or other flexible tube mounted to the end of the rigid tube. For example, the tube may be formed from a polyethylene polymer or other organic polymer. The bushing extends below the end of the rigid tube approximately the same distance as the helical bushing. In a further embodiment, the bushing 82B may surround a steel helical bushing similar to that shown in FIG. 4 to protect the helical bushing from the abrasive forces of the fracturing fluid. Alternatively, the rubber bushing may include steel reinforcing within the wall of the rubber bushing as depicted in FIG. 7. The steel reinforcing may be either in the form of circular wires or helical wires, where the helical wires have either a constant or increasing pitch. The rubber bushing may be fixed to the end of the rigid tube by any suitable means.

In the preferred embodiment, the length of that portion of the rigid tube in the flow passage may be in the range of ten feet. For a typical wire line diameter of 7/16 inch, the inside diameter of the rigid tube and therefore of the bushing may be in the range of $\frac{3}{4}$ inch to 1 inches. The outside diameter of the rigid tube may be in the range of 1 inch to $1\frac{1}{4}$ inch. A small rigid tube is preferred to minimize the obstruction to flow of the fracturing fluid. The length of the bushing may be on the order of one to two feet and the length of that portion of the bushing attached to the rigid tube may be approximately 3 inch. The bushing made from steel may be formed from hard spring steel as long as the bushing may be welded to the steel pipe.

Figure 3:
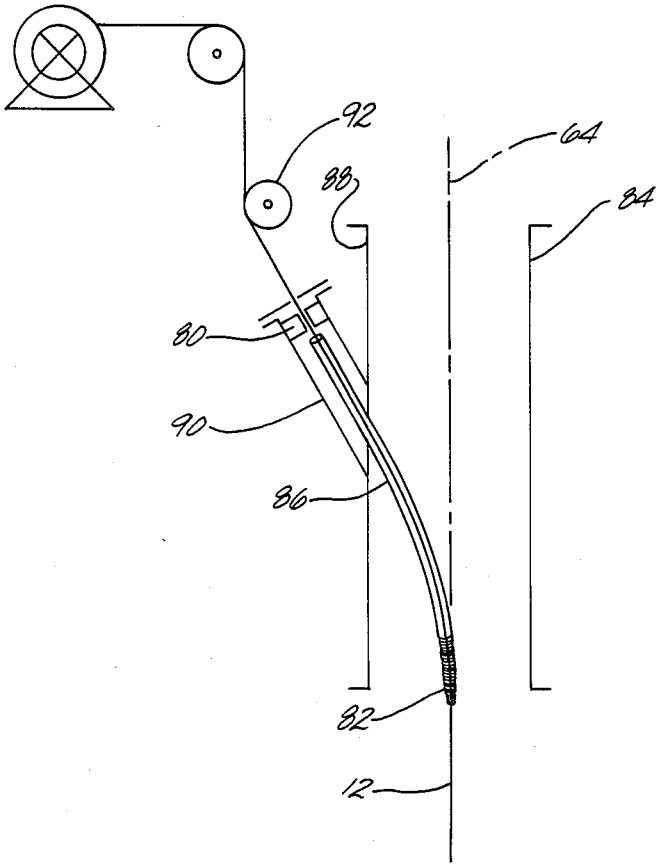
FIG. 3 is a schematic and cross sectional view of a wellhead assembly similar to that of FIG. 2 showing oblique side entry of a pipe with a bushing and a wire line passing therethrough.

FIG. 3 shows an alternative embodiment of the wire line adapting section of FIG. 2. The modified wire line adapting section 84 is used for accepting wire lines having longer tools mounted on the end of the wire line. In the configuration of FIG. 3, the curvature of the rigid tube is less so that tools can be easily passed into the flow channel and into the well through the rigid tube. A slightly curved rigid pipe 86 is fixed to wall 88 of the adapting section and curves downwardly into the flow passage until it is substantially coaxial with the axis 64. A tube housing 90 encloses that portion of the rigid tube outside the flow channel for protecting the rigid tube. Packing 80 for sealing the wire line in the housing is also provided similar to the arrangement in FIG. 2. A pulley 92 is provided for guiding the wire line in and out of the flow channel through the rigid tube. A bushing 82 is fixed to the end of the modified rigid tube in a manner similar to that described with respect to FIG. 2.

For accepting tools on the end of the wire line, where the tools may be approximately $\frac{3}{4}$ inch in outside diameter, the inside diameter of the pipe 86 may be between $\frac{3}{4}$ inch and 1 inch. The outside diameter of the pipe may be approximately 1 inch to $1\frac{1}{4}$ inch.

Figure 6:
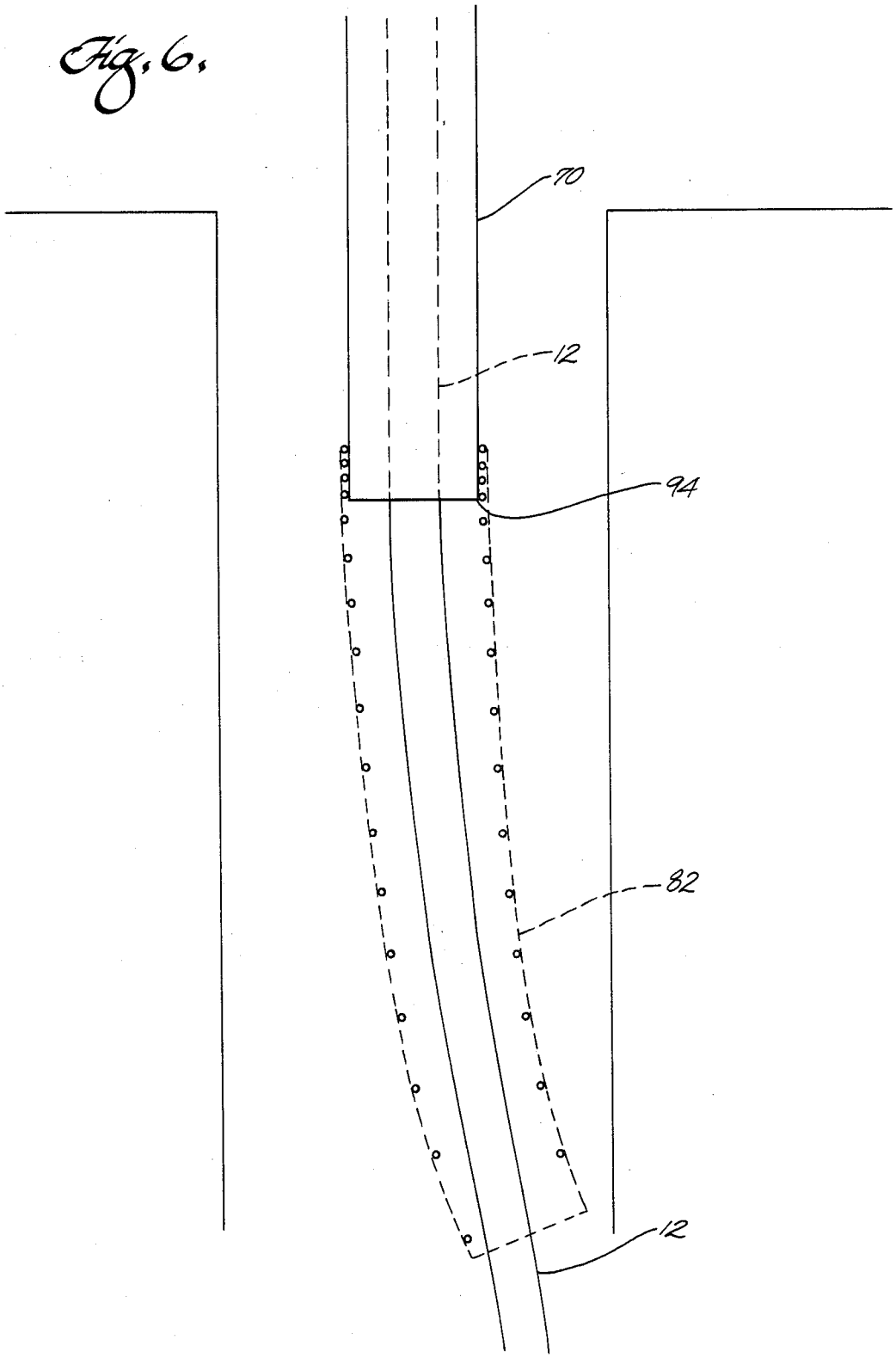
FIG. 6 is a schematic and side section of a wall containing a pipe and bushing according to the present invention and showing deflection of the bushing during flow of the fluid.

Significantly, the bushing is used to dampen vibrational forces induced in the wire line as a result of the turbulent flow of the fluid about the wire line with respect to the rigid tube. Since the probability of significant transverse forces on the wire line is relatively small, the major function of the bushing is as a damping agent rather than to inhibit kinking of the wire line. It is also significant that the wire line be allowed to pass through the rigid tube and bushing so that the wire line and tool attached thereto may be inserted in and removed from the well without having to remove the wire line adapting section. Furthermore, the bushing is significant in minimizing long term wear of the wire line with respect to the surrounding pipe rather than in preventing severance of the wire line resulting from one or two pulls in a direction transverse to the bushing. The damping effect of the bushing is depicted in FIG. 6. It is believed that repetitive contact of the wire line with the end 94 of the rigid tube is minimized. It is, also believed that the majority of the wear on the wire line occurs substantially over the length of the bushing rather than at any given point.

In a method for protecting a wire line from the effects of flow of an abrasive fluid past the wire line near a wellhead, the wire line adapting section is coupled to the wellhead, and in one embodiment, preferably between the wellhead and a valve assembly for introducing fluid into the well. The adapting section includes a rigid pipe passing through and fixed to the wall of the section. An external portion of the rigid pipe extends to the outside of the section and the remainder of the pipe, comprising an arcuate section and a substantially straight section, extends from the wall into the flow channel as discussed above. A bushing is attached at the end of the substantially straight portion and extends into the flow passage from the end of the rigid tube.

The wire line and an appropriate tool coupled to the end thereof may be introduced through the rigid tube into the wire line adapting section either before mounting of the section onto the wellhead or afterward. If the wire line is placed before mounting, the wire line is fed into the rigid tube and bushing and played out below the wire line adapting section. The tool is then placed on the end of the wire line, and the tool and wire line are placed in the wellhead down the well. The wire line adapting section is then mounted to the wellhead. The valve assembly may be mounted as desired. Alternatively, the tool may first be mounted to the wire line and both may be passed through the rigid tube and bushing. The wire line adapting section may then be mounted to the wellhead.

Where the wire line adapting section and the valve assembly are already mounted to the wellhead, the tool and wire line are passed through the rigid tube and bushing and into the well. The wire line is then played out from a wire line spool until the tool reaches the desired position in the well. The packing is adjusted to seal the wire line in the pipe as is known in the art. Once the wellhead equipment is configured, fluid may be introduced into the flow passage, for example, to form a fracture. Given the high pressure and flow rate of the fracturing fluid, a significant amount of turbulence may be created in the wire line adapting section and wellhead causing oscillation of the wire line with respect to the rigid tube. The oscillation is depicted in FIG. 6. The bushing dampens the oscillation substantially over the entire length of the bushing to minimize wear on the wire line due to frictional contact of the wire line with the rigid tube.

When the wire line and tool are no longer needed or need to be replaced, the wire line and tool may be removed through the bushing and rigid tube from the wire line adapting section. The pipe 78 may then be sealed and the pumping of fluid continued. Alternatively, a new wire line and tool may be inserted and the process continued. It is significant that the wire line and attached tools may be removed without removing the bushing, rigid tube, or wire line adapting section. Specifically, it is significant that the wire line can pass in and out of the bushing and rigid tube.

Figure 8:
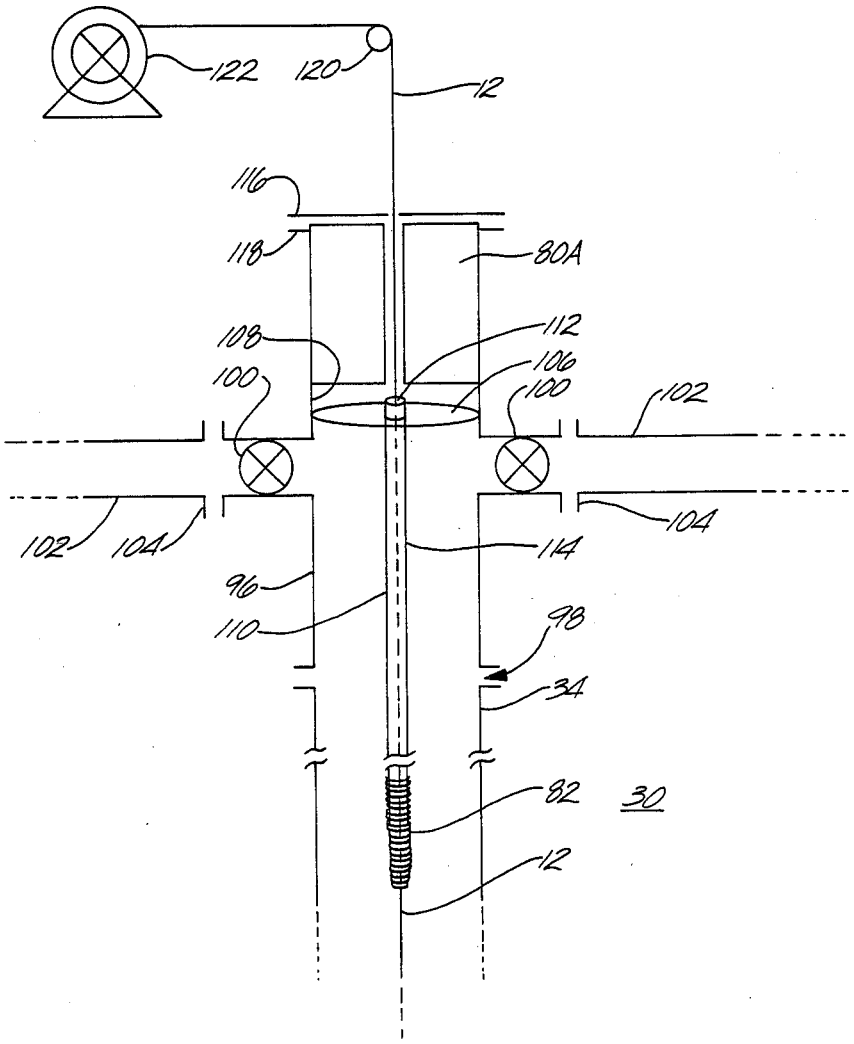
FIG. 8 is a schematic and cross sectional view of a wellhead and wellhead equipment for use with the present invention.

FIG. 8 shows a further embodiment of a wire line adapting section for use in conjunction with a wellhead and wellhead equipment. Elements identical to those discussed above with respect to FIGS. 1–7 have the same structure and function and are identically numbered. The remaining elements will be described below.

A wire line adapter section is combined with the fluid section and mounted to the wellhead 34 through a flange arrangement 98. The wire line adapter section includes one or more valves 100 for controlling flow of fluid through respective flow pipes 102 to the wire line adapter section from respective pumpers or other plumbing arrangements (not shown). The flow pipes are coupled to the wire line adapter section through respective flanges 104.

A steel plate 106 includes an outer circumferential edge conforming to the inside surface 108 of the wire line adapter section 96. The outer edge of the steel plate is welded to the inside surface of the wire line adapter section so that the juncture therebetween is fluid-tight. The steel plate is welded in a plane above the points of entry of the valves 100 so that the force of the fluid flow from the flow pipes does not significantly extend above the steel plate.

A rigid pipe 110 extends through an aperture formed in the center of the steel plate and is welded to the steel plate at the aperture. The rigid pipe includes an upper section 112 extending above the steel plate and a lower section 114 extending below the steel plate down the center of the wire line adapter section. In a preferred embodiment the rigid pipe extends to the wellhead, and into the surface casing, depending upon the height of the wellhead and the wire line adapter section. The length of the lower section is preferably on the order of 10 feet. A flexible bushing 82 is mounted to the lower end of the lower section in a manner similar to that described above and having the same function.

A sealing element 80A seals off the portion of the wire line adapter section above the steel plate 106 and seals the portion of the wire line 12 which passes through the sealing element. The sealing element serves the same function as the seal 80 described above with respect to FIG. 2. The top of the wire line adapter section is capped off with a cap 116 mounted through flange 118.

The arrangement of FIG. 8 is one preferred embodiment allowing support of the wire line from an overhead tower depicted schematically by pulley 120 and wire line spool 122. This arrangement also allows for deployment of longer rigid tools that would not ordinarily fit through the rigid pipe described above with respect to FIGS. 2 or 3. The function of the rigid pipe and the flexible bushing are generally the same as described above with respect to the corresponding elements in the drawings. The flexible bushing protects the wire line while the fluid, such as fracturing fluid, is pumped into the well. The rigid pipe and flexible bushing allow for insertion and removal of the wire line and associated wire line tools, even while the wire line adapter section is in place on the wellhead. Additionally, the sealing element and cap allow for repositioning of the wire line and the associated tools in the well, even after the sealing elements are set. This is done by releasing the sealing elements and moving the wire line into or out of the well with the spool and reforming the seal.

It should be noted that the above are preferred configurations, but others are foreseeable. The described embodiments of the invention are only considered to be preferred and illustrative of the inventive concept; the scope of the invention is not to be restricted to such embodiments. Various and numerous other arrangements may be devised by one skilled in the art without departing from the spirit and scope of the invention.

What is claimed is:

1. An apparatus for introducing a flowing fluid and a wire line through a wellhead of a well into a flow passage of a well and for protecting the wire line from wear due to a flow of such fluid about the wire line, the apparatus comprising:

means for introducing flowing fluid down into the flow passage of the well through the wellhead;

a wire line adaptor for passing the wire line from outside the well into the flowing fluid in the flow passage through the wellhead and comprising a hollow rigid tube with an opening end for passing the wire line into the flow passage in the direction of the flowing fluid and a flexible bushing coupled to the tube and extending beyond the end of the tube and substantially in the direction of the flowing fluid, the bushing having a lower end in the flowing fluid below the introduction of the flowing fluid into the flow passage; and a wire line slidable from the outside of the adaptor section through the tube and bushing and out the end of the tube.

2. The apparatus as claimed in claim 1 further comprising means coupled to the fluid introducing means for pumping fracturing fluid to the wellhead past the end of the tube and along the wire line.

3. The apparatus as claimed in claim 1 wherein the bushing comprises a steel bushing.

4. The apparatus as claimed in claim 1 wherein the bushing comprises a substantially helical coil.

5. The apparatus as claimed in claim 1 further comprising means for providing a seal about the wire line.

6. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, wherein the bushing comprises a substantially helical coil having an increasing pitch between adjacent turns extending away from the tube.

7. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing comprising a coil coupled to the tube and extending beyond the end of the tube and in the direction of the flowing fluid; and a wire line slidable from the outside of the adaptor section through the tube and bushing and out the end of the tube, and wherein the coil comprises a coil having a decreasing inside diameter in a direction away from the tube and an increasing pitch between adjacent turns extending away from the tube.

8. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, and wherein the bushing further comprises a flexible tube substantially covering the coil.

9. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, and wherein the bushing is adapted to be more flexible at a point spaced from the rigid tube than at a point adjacent the rigid tube.

10. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, and wherein the rigid tube comprises an inside diameter of approximately one inch.

11. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, and wherein the bushing comprises a wire reinforced flexible tube.

12. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, wherein the end of the hollow tube extends below the fluid introducing means in the well.

13. A method for protecting a wire line extending from a rigid tube at a top of a well from wear due to flow of a fluid along the tube, past an end of the tube from which the wire line extends, and along the wire line, the method comprising the steps of:

passing the wire line inside the tube and through a flexible bushing coupled so that the wire line extends from the bushing and beyond the end of the tube while such fluid flows along the tube, the bushing and the wire line to cause the bushing to damp transverse movement of the wire line adjacent the tube opening, and wherein the rigid tube comprises a bent rigid tube passing into the well and wherein the step of passing the wire line comprises the step of passing the wire line inside the bent rigid tube.

14. The method as claimed in claim 13 further comprising the step of introducing fracture fluid into the well for forming a fracture.

15. The method as claimed in claim 14 further comprising the step of mounting a tool on an end of the wire line.

16. The method as claimed in claim 15 wherein the step of mounting the tool precedes the step of passing the wire line.

17. An apparatus for introducing a flowing fluid and a wire line through a wellhead of a well into a flow passage of a well and for protecting the wire line from wear due to a flow of such fluid about the wire line, the apparatus comprising:

means for introducing flowing fluid into the flow passage of the well through the wellhead;

a wire line adaptor for passing the wire line from outside the well into the flow passage through the wellhead and comprising a hollow rigid tube with an opening end in the flowing fluid in the flow passage for passing the wire line into the flow passage in the direction of the flowing fluid and a flexible bushing coupled to the tube and extending beyond the end of the tube and in the direction of the flowing fluid; and a wire line slidable from the outside of the adaptor section through the tube and bushing and out the end of the tube, and wherein the flow passage has a longitudinal axis along which the fluid flows and the rigid tube, at the opening end thereof, extends substantially parallel with such axis.

18. A method in a well, for protecting a wire line from damage due to the flow of fluid past a tube through which the wire line is introduced into the flow of fluid in the well, and comprising the steps of:

introducing the flowing fluid down into the well;

positioning the wire line through the tube and a flexible bushing, which is coupled to the tube and which extends past the end of the tube, and into the flow of such fluid in the well while a lower end of the bushing is positioned below the introduction of the fluid into the well to thereby damp transverse movement of the wire line adjacent the end of the tube due to the effect on the wire line of the flow of the fluid past the end of the tube.

19. The method of claim 18 wherein there is an inlet for the fluid being introduced into the well and comprising the step of positioning at least a portion of the tube including the end thereof, and the flexible bushing down in the flow of fluid in the well with respect to the inlet of such fluid such that the fluid will flow along said portion on the tube, the flexible bushing and said wire line.

20. The method of claim 18 wherein there is an inlet for the fluid being introduced into the well and comprising the step of positioning the lower end of the bushing below the inlet such that the flow of the fluid is along the flexible bushing and said wire line.

* * * * *

UNITED STATES PATENT AND TRADEMARK OFFICE

CERTIFICATE OF CORRECTION

PATENT NO. : 4,848,480

DATED : July 18, 1989

INVENTOR(S) : P.F. Titchener; M.J.M. Walsh; M.E. Hanson

It is certified that error appears in the above-identified patent and that said Letters Patent is hereby corrected as shown below:

On the Front Page:

Abstract, line 10, after "coupled to" change "an" to -- and --.
Abstract, line 13, after "section" insert -- of --.

Column 3, line 48, change "exists" to -- exits --.

Column 4, line 15, change "inch" to -- inches --.
Column 4, line 21, change "inch" to -- inches --.
Column 4, line 46, change "inch" to -- inches --.
Column 4, line 65, after "is" delete the comma.

Column 5, line 62, delete "to".

Signed and Sealed this

Twenty-eighth Day of May, 1991

*Attest:*

HARRY F. MANBECK, JR.

*Attesting Officer*

*Commissioner of Patents and Trademarks*